US005423522A

United States Patent [19]

Forte et al.

[11] Patent Number: 5,423,522

[45] Date of Patent: * Jun. 13, 1995

[54] SLAG CONTROL SHAPE RELEASE APPARATUS FOR MOLTEN METAL VESSELS

[75] Inventors: Gary L. Forte, Plymouth; James P. McGuire, Taylor; Wayne Miller, Gibraltar, all of Mich.

[73] Assignee: AJF, Inc., Plymouth, Mich.

[ * ] Notice: The portion of the term of this patent subsequent to Oct. 5, 2010 has been disclaimed.

[21] Appl. No.: 196,309

[22] Filed: Feb. 15, 1994

Related U.S. Application Data

[63] Continuation-in-part of Ser. No. 15,559, Feb. 9, 1993, Pat. No. 5,303,902, and a continuation-in-part of Ser. No. 898,014, Jun. 12, 1992, Pat. No. 5,249,780.

[51] Int. Cl.[6] ..... B22D 41/14

[52] U.S. Cl. ..... 266/230; 266/227

[58] Field of Search ..... 266/230, 272, 227, 45; 222/594, 597, 590, 591

[56] References Cited

U.S. PATENT DOCUMENTS

| | | | |
|---|---|---|---|
| 11,676 | 9/1854 | Morris | 73/323 |
| 2,295,932 | 9/1942 | Campbell | 254/173 |
| 3,459,209 | 8/1969 | Kobusch et al. | 222/597 |
| 4,431,169 | 2/1984 | Fuzil et al. | 266/236 |
| 4,468,013 | 8/1984 | LaBate | 266/272 |
| 4,526,349 | 7/1985 | Schwer | 266/45 |
| 4,553,743 | 11/1985 | LaBate, II et al. | 266/272 |
| 4,601,415 | 7/1986 | Koffron | 222/597 |
| 4,610,436 | 9/1986 | LaBate, II et al. | 266/272 |
| 4,637,592 | 1/1987 | LaBate, II et al. | 266/272 |
| 4,640,498 | 2/1987 | LaBate, II et al. | 266/272 |
| 4,709,903 | 12/1987 | LaBate | 266/272 |
| 4,725,045 | 2/1988 | Cutre et al. | 266/230 |
| 4,871,148 | 10/1989 | Koffron | 266/230 |
| 4,922,994 | 5/1990 | Ogura | 266/230 |
| 4,968,007 | 11/1990 | Forte et al. | 266/100 |
| 5,044,610 | 9/1991 | Koffron | 266/45 |
| 5,249,780 | 10/1993 | Forte et al. | 266/230 |
| 5,303,902 | 4/1994 | Forte et al. | 266/230 |

FOREIGN PATENT DOCUMENTS

| | | |
|---|---|---|
| 57-171568 | 10/1982 | Japan . |
| 62-203667 | 9/1987 | Japan . |
| 0175142 | 3/1989 | Japan . |
| 0517542 | 2/1972 | Switzerland . |

*Primary Examiner*—Scott Kastler
*Attorney, Agent, or Firm*—Basile and Hanlon

[57] ABSTRACT

A slag control shape is releasably mounted on a cover for a molten metal vessel. An actuator is connected to a slag control shape release member to retract the release member from a first position engaged with the slag control shape to a second position separated from the slag control shape to allow the slag control shape to freely drop into the molten metal receptacle. The actuating end of the actuator is located at an easily accessible operator position for remote actuation of the release member. In another embodiment, one end of a cable wound in a plurality of turns about a rotatable shaft mounted in a reel is attached to the slag control shape. A spring biasingly engages the shaft to control the rate of rotation of the shaft and thereby the rate of payout of the cable and the rate of descent of the slag control shape into the molten metal vessel. In another embodiment, the release member is mounted on a lid removably mountable in a bore in the cover and the actuator is mounted on the cover and releasibly connected to the release member. In yet another embodiment, the release member is mounted on a base which is in turn removably mounted in the bore in the cover. The hanger of a slag control shape extends through an aperture in the base and is engaged by the release member on the base.

11 Claims, 8 Drawing Sheets

SLAG CONTROL SHAPE RELEASE APPARATUS FOR MOLTEN METAL VESSELS

CROSS REFERENCE TO CO-PENDING APPLICATIONS

The present invention is a continuation-in-part application of U.S. patent application Ser. No. 08/015,559, filed Feb. 2, 1993, now U.S. Pat. No. 5,303,902, issued Apr. 19, 1994, and a continuation-in-part of application Ser. No. 07/898,014, now U.S. Pat. No. 5,249,780, issued Oct. 5, 1993, both filed in the names of Gary L. Forte, James P. McGuire and Wayne Miller and entitled "SLAG CONTROL SHAPE RELEASE APPARATUS FOR MOLTEN METAL VESSELS."

BACKGROUND OF THE INVENTION

1. Field of the Invention

The present invention relates, in general, to metal making apparatus and, specifically, to molten metal receptacles and, more specifically, to slag control shapes used in molten metal vessels.

2. Description of the Art

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frusto-conical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, based on the total time of molten metal discharge, or on a potentially inaccurate scale reading. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Further, when such slag control shapes are dropped into a molten metal vessel, they typically fall from 10 to 15 feet before hitting the slag layer. Due to the buoyancy characteristics of a slag control shape and its momentum during dropping into the vessel, the slag control shape will initially pass through the slag layer and into the molten metal and then bob up out of the molten metal and slag until it settles at the molten metal/slag interface. However, this bobbing force and the inherent buoyancy characteristics of a slag control shape frequently cause the slag control shape to settle at a position away from a desired position directed above the discharge outlet of the molten metal vessel. Indeed, it is infrequent for the slag control shape to settle directly over the discharge outlet since the discharge outlet is typically 2½ to 4½ inches in diameter as compared to the 10 to 20 foot diameter of a typical ladle. Thus, when a vortex begins to form above the discharge outlet when the molten metal reaches a low level within the ladle or vessel, the slag control shape may not be able to reach the vortex in time to serve its function of blocking the outlet to prevent the discharge of slag through the outlet. Furthermore, even if the slag control shape initially settles directly over the discharge outlet, it frequently drifts away since a vortex may not have formed above the outlet and never returns to the desired centered position thereby defeating its intended purpose.

In order to address these problems, the applicants' previously devised a slag control shape release apparatus which is disclosed in U.S. Pat. No. 5,249,780 issued on Oct. 5, 1993. In this apparatus, the hanger of a slag control shape extends through a bore in a molten metal vessel cover and, also, through a bore in a lid pivotally mounted on the cover. A pin is mounted on the lid and biased to a position extending through the hanger to support the slag control shape on the cover. An actuating cable is connected to the pin and extends from the cover to an easily accessible position for remote actuation of the release mechanism to release the pin from the slag control shape and to allow the descent of the slag control shape into the molten metal vessel.

A similar release apparatus has also been devised by the applicants and is disclosed in co-pending application Ser. No. 08/015,559, filed on Feb. 9, 1993. In this apparatus, a mounting means including a reciprocally movable pin is mounted on a frame pivotally mounted on the cover of a molten metal vessel and is actuated by a cable extending from the pin to a free end remote from the cover. A cable wound around a reel mounted on the frame is attached to the slag control shape to control the descent of the slag control shape into the molten metal vessel after release from the pin.

While both of these apparatus have proved effective at accurately dropping a slag control shape into a molten metal vessel and permitting the timely release of the slag control shape from an easily accessible location remote from the cover or top of a molten metal vessel, it has been found that the release mechanism is too heavy to be permanently mounted on covers formed of lightweight refractory or ceramic fiber materials.

Thus, it would be desirable to provide an apparatus for inserting a slag control shape into a molten metal vessel which is mountable on molten metal vessel covers formed of lightweight refractory or ceramic fiber materials. It would also be desirable to provide such an apparatus which provides easy and quick mounting of the slag control shape on the cover of a molten metal vessel.

SUMMARY OF THE INVENTION

The present invention is a slag control shape release apparatus for a molten metal receptacle having an open top end, side and bottom walls, an interior cavity containing a layer of slag covering a layer of molten metal, a discharge nozzle formed in the bottom wall, a cover removably closing the open top end of the receptacle and having an aperture extending therethrough, and a slag control shape insertable into the receptacle and buoyantly supported at the interface between the layer of slag and the layer of molten metal, the slag control shape release apparatus includes means, mounted on the cover, for releasably mounting the slag control shape on the cover and means, connected to the mounting means, for actuating the mounting means to release the slag control shape from the cover into the molten metal receptacle, the actuating means being operable from a location remote from the cover when the cover is mounted on the molten metal receptacle.

In one embodiment, the mounting means comprises an aperture formed in the cover through which a hanger mounted on and extending outward from the slag control shape extends. A pin is slidably mounted on the cover and is biased to a first, extended position in which the pin engages the hanger to support the slag control shape on the cover.

The actuating means, in one embodiment, comprises a flexible cable having a first end connected to the mounting means or pin. The cable has a second end located remote from the pin at an easily accessible position for retraction of the mounting means or pin from the first position to the second retracted position. The second end of the cable is located at a remote location from the cover in an easily accessible position for an operator attending to the molten metal process utilizing the molten metal receptacle.

In another embodiment, the actuating means comprises first and second eccentric cams mounted on the cover and the molten metal receptacle, respectively. A first cable is fixedly connected at one end to the first cam and to the mounting means or pin at another end. A second cable is fixedly connected to the second cam at one end and has a second end located at a position remote from the second cam. The first and second cams are disposed in close proximity when the cover is mounted on the molten metal receptacle such that movement of the second cable causes rotation of the second cam into engagement with and simultaneous rotation of the first cam to move the first cable in a direction to retract the mounting means or pin to the second, retracted position to release the pin from engagement with the slag control shape and enabling the slag control shape to drop into the interior of the molten metal receptacle.

In yet another embodiment, means are attached to the slag control shape for controlling the rate of descent of the slag control shape into the molten metal vessel after the slag control shape has been released from the mounting means. The means for controlling the rate of descent of the slag control shape includes a rotatable shaft mounted on a reel affixed to the slag control shape mounting means. A flexible cable is wound in a plurality of turns about the shaft and is attached at one end to the slag control shape. Means are provided for maintaining the rate of rotation of the shaft constant after release of the slag control shape from the mounting means to thereby control the rate of descent of the slag control shape into the molten metal vessel until the slag control shape reaches and settles at the molten metal/slag interface in the vessel.

The constant rotation maintaining means preferably comprises a plate movably disposed with respect to the shaft. A biasing means urges the plate into engagement with the shaft under a predetermined frictional force to provide a constant rate of rotation of the shaft and payout of the cable from the shaft to control the rate of descent of the slag control shape into the molten metal vessel.

This latter embodiment is ideally suited to provide a specific indication of the depth of the molten metal/slag interface or the height of molten metal remaining in the vessel. A detector is mounted on the reel to detect the number of revolutions of the shaft. The shaft may be provided with spirally shaped grooves, each receiving one turn of the cable, such that the cable is wound in a plurality of turns, each turn having the same diameter along the length of the shaft. In this manner, the number of rotations of the shaft may be used to calculate the length of cable paid out and thereby the distance the slag control shape has descended into the vessel by means of a counter connected to the detector. This provides an indication, based on the known height of the molten metal vessel, of the height of molten metal remaining in the vessel after the slag control shape has settled at the molten metal/slag interface.

In another embodiment, a slag control shape release apparatus is devised for use on a molten metal receptacle having an open top and a cover closing the open top of the receptacle. A bore is formed in and extends through the cover. The release apparatus includes a lid removably implacable in and closing the bore in the cover. An aperture extends through the lid for receiving the hanger or rod of a slag control shape therethrough. Means are mounted on the lid for releasibly mounting the slag control shape on the lid. An actuating means is fixedly mounted on the cover and is releasibly connected to the mounting means for actuating the mounting means to release the slag control shape from the mounting means and to allow the descent of the slag control shape into the molten metal receptacle. The actuating means is operable from a location remote from the cover mounted on the molten metal receptacle. Finally, means are provided for releasibly connecting the actuating means to the mounting means after the mounting means and the lid have been mounted on the cover.

In a preferred embodiment, the mounting means comprises a frame fixedly mounted on the lid and slidably supporting a tubular pin. The pin has a first end extendible through the frame for supporting the hanger of a slag control shape extending through the aperture in the lid. A biasing means is mounted on the frame and engages the pin to normally bias the pin to a first position in which the first end of the pin extends over and past the aperture in the lid for supporting the hanger of a slag control shape thereon. Stop means are also mounted on the rod and engagable with the frame for limiting the axial movement of the rod to the first position.

In yet another embodiment, the cover of the molten metal vessel is provided with a through bore which communicates with the interior chamber of the molten metal receptacle or vessel. The release apparatus in this embodiment includes a base having an aperture therein. A pin is provided with first and second ends. Means are mounted on the base for slidably mounting the pin for axial sliding movement with respect to the aperture in the base. An actuating means is connected to the second end of the pin. The opposite end of the actuating means is located at a remote, easily accessible position for retracting the pin from the first position to separate the pin from the hanger of the slag control shape to allow the descent of the slag control shape into the molten metal vessel.

In this embodiment, the mounting means comprises a frame formed of a plurality of spaced plates mounted on the base. A biasing means is mounted between two of the plates for normally biasing a first end of the pin to a first position beyond the aperture in the base to support the hanger of the slag control shape on the pin. Means for limiting the axial advance of the pin toward the first position are also mounted on the pin and cooperate with at least one of the plates in the base. A guide member is mounted on and extends from the base and concentrically surrounds the aperture in the base. The guide member is slidably mountable into the bore in the cover for releasibly mounting the release apparatus on the cover of a molten metal vessel.

Both of the latter two embodiments provide for remote release of a slag control shape from the cover into a molten metal vessel. However, the apparatus employed to releasibly mount the slag control shape on the cover is light in weight to permit the mounting apparatus to be mounted on molten metal vessel covers formed of lightweight refractory or ceramic fiber materials. At the same time, the mounting apparatus permits easy mounting of the slag control shape on the cover of a molten metal vessel.

The slag control shape release apparatus of the present invention overcomes certain problems associated with the use of such slag control shapes in molten metal receptacles, such as ladles or tundishes. The release apparatus of the present invention enables the slag control shape to be automatically dropped at the proper time, as determined by a ladleman, into the interior of the molten metal receptacle wherein the slag control shape is buoyantly supported at the slag/molten metal interface directly above the discharge nozzle to prevent the discharge of slag from the molten metal receptacle when the layer of molten metal reaches a critical, low level within the molten metal receptacle. The same operator or ladleman attending to the molten metal process utilizing the molten metal receptacle can thusly control the release of the slag control shape at the proper time without leaving his normal work station or neglecting his other duties.

The slag control shape release apparatus of the present invention also eliminates the need for overhead cranes to drop slag control shapes into molten metal receptacles as well as the use of an individual specifically assigned the task of inserting the slag control shape into the molten metal receptacle at the proper time.

The slag control shape release apparatus of the present invention is of simple and inexpensive construction and can be easily mounted on existing molten metal receptacle covers without extensive modification of such covers or molten metal receptacles.

The slag control shape of the present invention also ensures that the slag control shape remains centered directly above the discharge outlet of a molten metal vessel. This enables the slag control shape to consistently and repeatedly perform its intended purpose of blocking the discharge outlet when the molten metal/slag interface reaches a predetermined low level to prevent the discharge of slag through the outlet in the vessel.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a slag control shape or body release apparatus which inserts a slag control shape into a molten metal vessel, such as a transfer ladle or tundish, at an appropriate time determined by an operator or ladleman.

Figure 1:
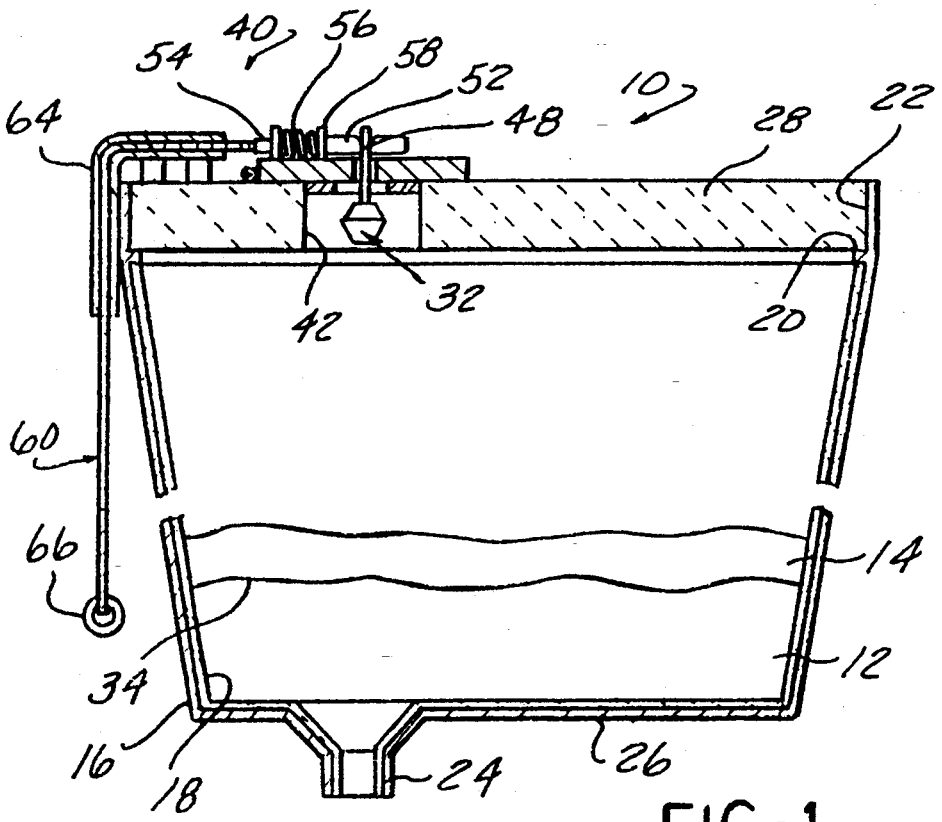
FIG. 1 is a cross-sectioned, side view of a slag control shape release apparatus of the present invention mounted on a transfer ladle.

As shown in FIG. 1, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish or casting machine, it will be understood that the slag control release apparatus of the present invention may also be employed with other types of molten metal vessels, such as tundishes, etc.

By way of background, the molten metal vessel or ladle 10 includes outer, generally conical side walls formed of a metallic outer shell 16 and an inner layer 18 formed of a refractory material, such as firebrick, etc. A shoulder denoted by reference number 20 is formed adjacent an open top end 22 of the ladle 10. A discharge nozzle or outlet 24 is formed in a bottom wall 26 of the ladle 10 and provides an outlet path for molten metal from the ladle 10 to a tundish, casting machine, etc.

Figure 3:
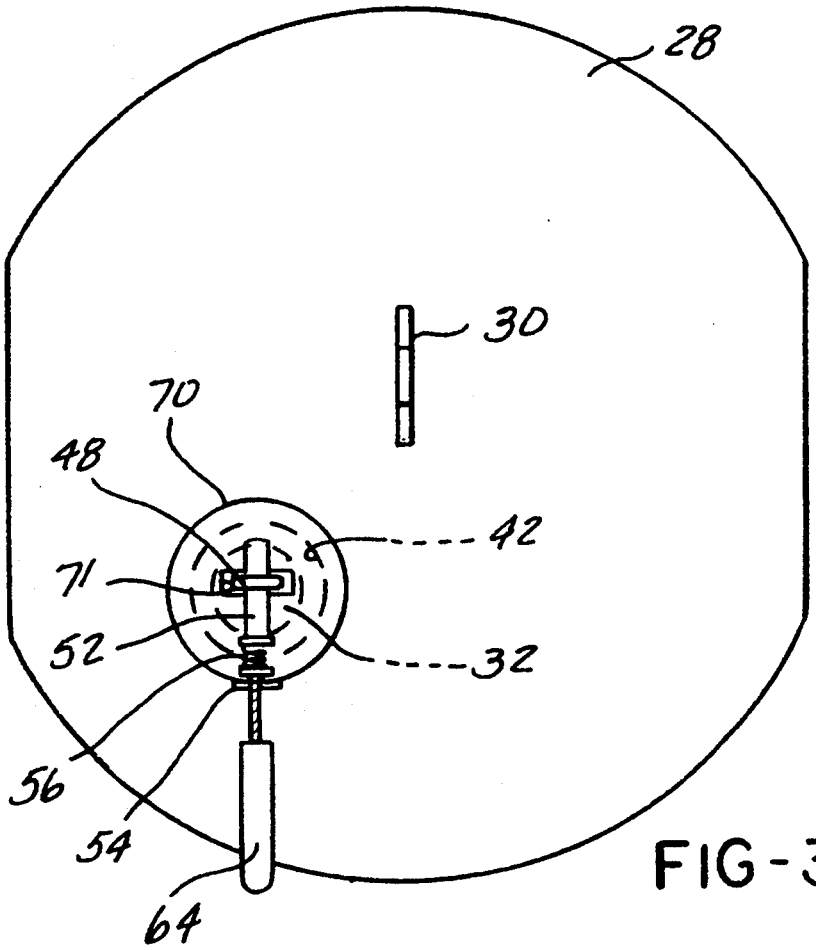
FIG. 3 is a plan view of the slag control shape release apparatus and transfer ladle cover shown in FIG. 1.

Although not required or always used, a cover 28 having a generally circular shape with two opposed straight sides, as shown in FIG. 3, is formed of a refractory material and is removably inserted into the shoulder 20 in the open top end 22 of the ladle 10 to close off the interior of the ladle 10 in order to retain heat within the molten metal 12 in the ladle 10. The cover 28 is mounted on and removed from the ladle 10 by means of a crane which engages a hook 30 mounted on the cover 10.

As is conventional, a slag control shape or body denoted generally by reference number 32, is employed to prevent the discharge of slag 14 through the discharge nozzle 24 when the layer 12 of molten metal reaches a predetermined low depth. The slag control shape or body 32 may have any predetermined size and shape, such as that disclosed in applicant's own Pat. No. 4,968,007 or the plug shown in U.S. Pat. No. 4,725,045. The contents of U.S. Pat. No. 4,968,007, with regard to the description and use of the slag control body, is incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will first prevent the vortex action from occurring and as draining is completed, will engage the discharge nozzle 24 in the ladle 10 and thereby block the further discharge of molten metal and, more importantly, the discharge of slag 14 from the ladle 10.

According to the present invention, a slag control shape release apparatus 40 is provided for inserting the slag control shape or body 32 into the ladle 10 at the appropriate time determined by an operator monitoring the metal making process utilizing the ladle 10. The apparatus 40 includes a means for releasably mounting the slag control shape or body 32 on the cover 28 and, means, connected to the mounting means, for actuating the mounting means to release the slag control shape 32 from the cover 28, the actuating means being operable and accessible to the operator at a location remote from the cover 28. In a preferred embodiment, a bore 42 is formed in the cover 28 generally centered over the discharge nozzle 24. Suitable locating means, not shown, will also be formed on the cover 28 to insure that the cover 28 is inserted in the proper position on the ladle 10 to position the bore 42 in the cover 28 substantially over the discharge nozzle 24 of the ladle 10. An upper end 44 of the bore 42 is closed off by means of an extension of the cover 28 or by separate high temperature insulation which is attached to the cover 28. A smaller aperture 46 is formed in the extension 44 and receives a hanger 48 integrally formed with and extending outward from one end of the slag control shape 32. The hanger 48 has a central aperture 50 extending therethrough for receiving a slidable pin 52. The pin 52 is part of the slag control shape mounting means and is slidably supported on the top surface of a lid 70.

Figure 2:
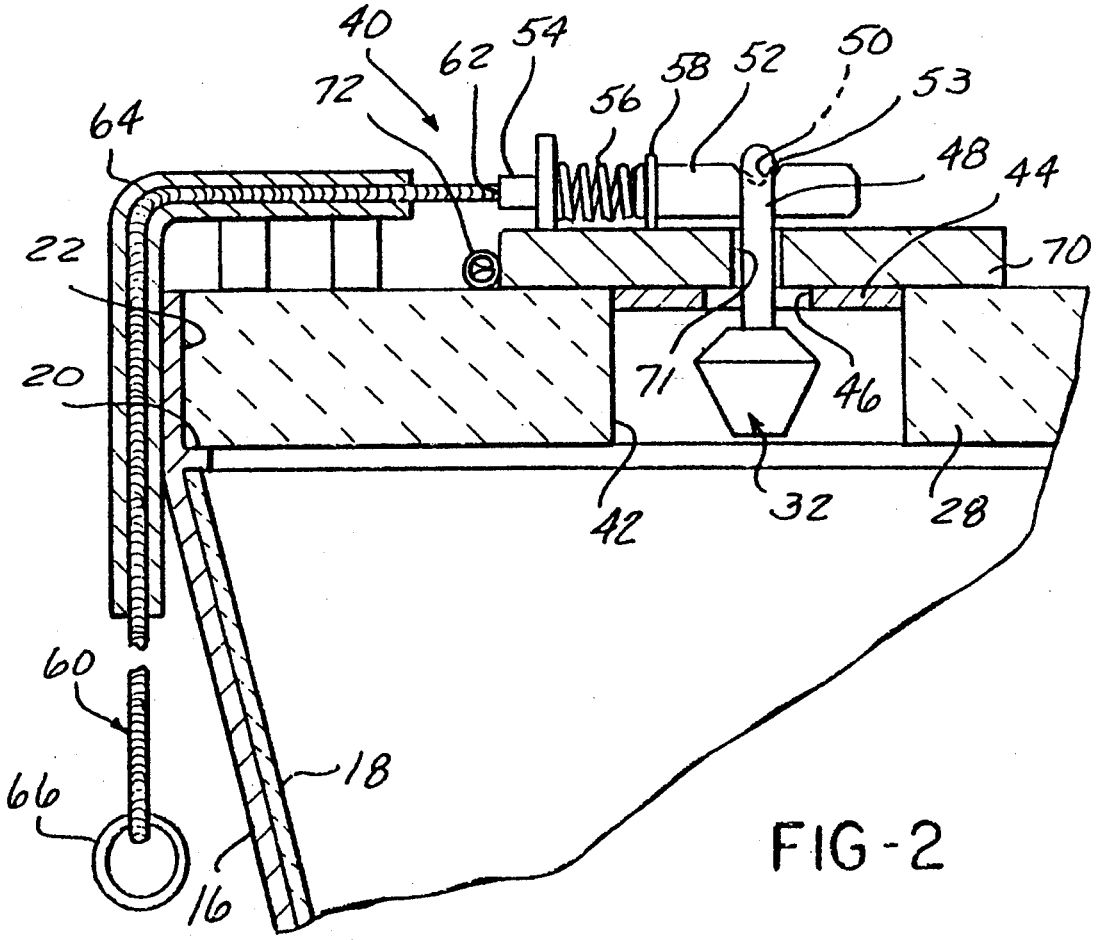
FIG. 2 is a partial, enlarged view of the slag control shape release apparatus shown in FIG. 1.

As shown in FIGS. 1–3, the lid 70 is pivotally mounted on the top surface of the cover 28 by means of a suitable hinge 72. The lid 70 covers the upper opening of the bore 42 in the cover 28 to retain heat within the ladle 10 when the cover 28 is mounted on the ladle 10. The slot 71 is formed in the lid 70 to receive the hanger 48 of the slag control shape 32 therethrough as described above.

The pin 52 includes a notch 53 which engages and supports the slag control shape hanger 48 when the pin 52 is in a first extended position shown in FIGS. 1 and 2.

The mounting means also includes a stop bracket 54 which is attached to the top surface of the lid 70 and has a bore extending therethrough. A biasing means, such as a coil spring 56, engages the stop bracket 54 at one end and one end 58 of the pin 52 at another end. The biasing means 56 normally biases the pin 52 to the first, extended position shown in FIGS. 1 and 2. However, the biasing force of the biasing spring 56 is overcome, as described hereafter, by a force exerted on an actuating means which moves the pin 52 to a second position separated from the hanger 48 on the slag control shape 32 and allows the slag control shape 32 to freely drop into the interior of the ladle 10 for normal functioning of the slag control shape 32.

Figure 4:
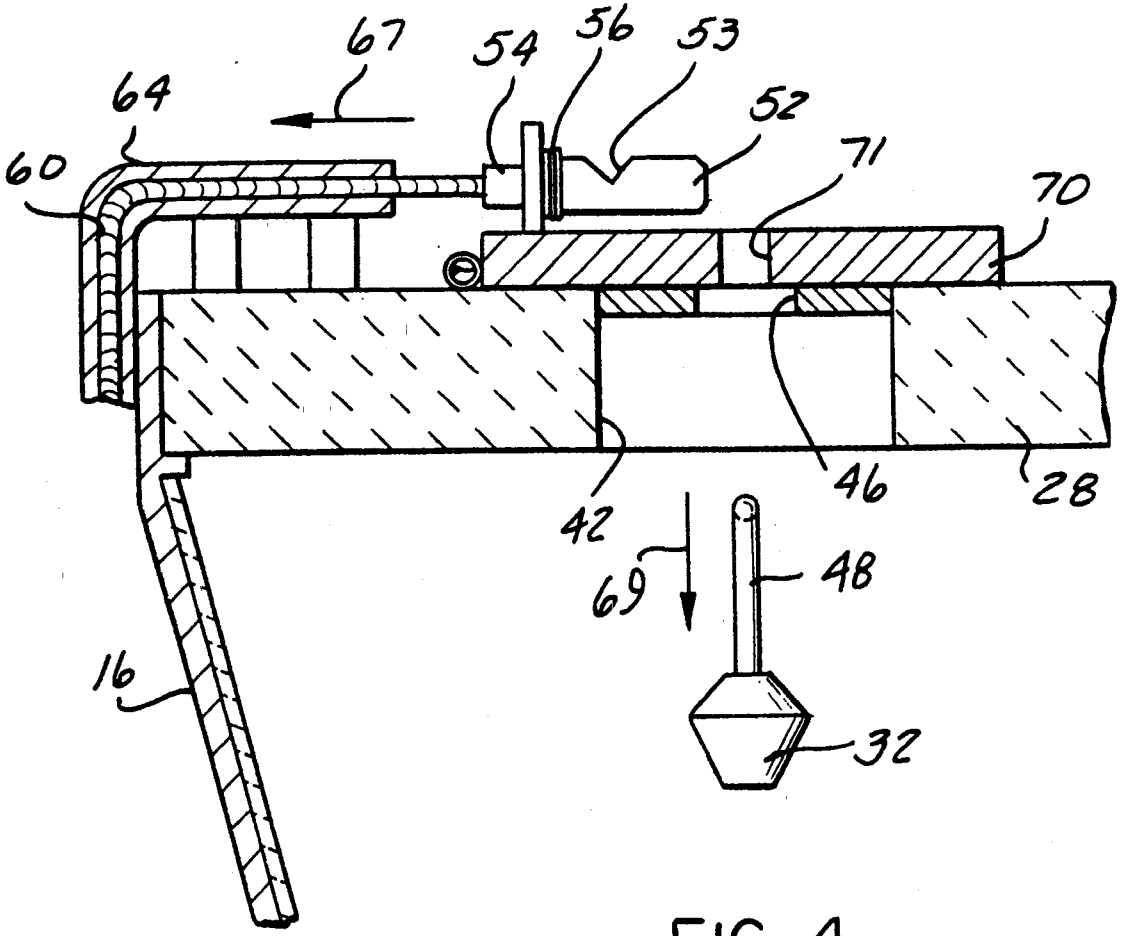
FIG. 4 is a partial, enlarging view similar to FIG. 2, but shown in the pin in its second, retracted position.

In a preferred embodiment, the actuating means comprises a flexible cable, such as a steel cable 60. A first end 62 of the cable 60 extends through the bore in the stop bracket 54 and is fixedly connected to the pin 52. The cable 60 is surrounded by the biasing spring 56 as shown in FIG. 2. Further, a cable sleeve 64 in the form of a hollow, steel conduit is attached to the upper edge of the cover 28 and extends downward below the cover 28 and an adjoining portion of the side wall 16 of the ladle 10 when the cover 28 is mounted on the top end 22 of the ladle 10 to protect a portion of the cable 60. A second end 66 of the actuating cable 60 is located at a position remote from the cover 28 when the cover 28 is mounted on the top end 22 of the ladle 10. Preferably, the second end 66 of the cable 60 is located at an easily accessible position for an operator, such as a ladleman, typically situated near the bottom of the ladle 10. The ladleman can pull downward on the second end 66 of the cable 60 to retract the pin 52 from the first position shown in FIG. 2 in the direction of the arrow 67 in FIG. 4 to the second, retracted position shown in FIG. 4 thereby pulling the pin 52 from the hanger 48 on the slag control shape 32 and allowing the slag control shape 32 to freely drop into the interior of the ladle 10, arrow 69 in FIG. 4, wherein it will buoyantly float at the slag/molten metal interface 16 in the ladle 10.

It will also be understood that the second end 66 of the cable 60 may be located at any other convenient position with respect to the ladle 10. For example, the cable 60 may be wrapped around the outer surface of the ladle 10 by means of a suitably shaped cable sleeve, similar to cable sleeve 64, to the right-hand side of the ladle 10 in the orientation shown in FIG. 1. Further, instead of using manual force to actuate the cable 60, various power drive means, such as fluid cylinders, etc., may be connected to the cable 60 for driving the second end 66 of the cable 60 in a direction to retract the pin 52 from the hanger 48 on the slag control shape 32 as described above.

Figure 5:
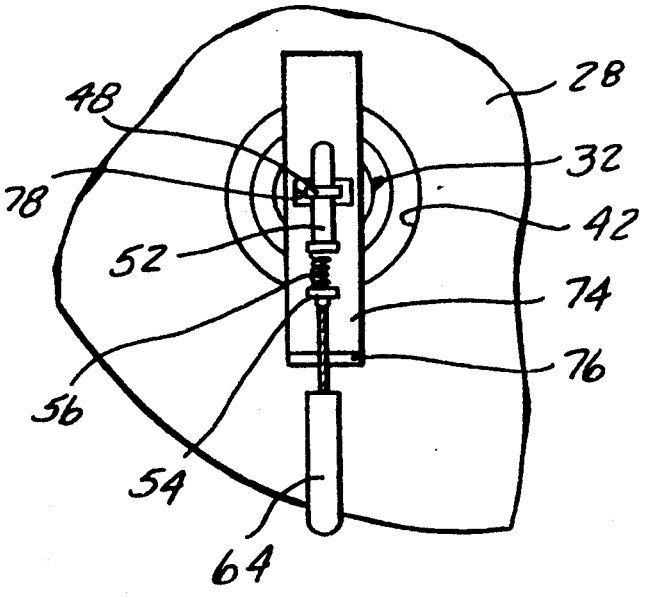
FIG. 5 is a partial, plan view showing another embodiment of the slag control shape release apparatus of the present invention.

In another embodiment shown in FIG. 5, a narrow, strip-like bar 74 is mounted on the cover 28 by means of a hinge 76 and extends over the open end of the bore 42 in the cover 28. The stop bracket 54 is mounted on the bar 74 as well as the movable pin 52. A slot 78 is formed in the bar 74 for receiving the slag control shape 32 hanger 48 therethrough in the same manner as described above to enable the pin 52 to engage the hanger 48 and thereby mount the slag control shape 32 in the cover 28 prior to its release as described above by means of actuation of the cable 60. The bar 74 is pivotal away from the cover 28 to enable the slag control shape 32 to be inserted in the bore 42 in the cover 28.

In a normal sequence of operation, the cover 28 will be situated on the floor during emptying of the ladle 10 from a previous heat or load of molten metal and slag. At this time, the hinged lid 70 or bar 74 may be pivoted upward to enable the insertion of the slag control shape 32 into the bore 42 in the cover 28. The cover 70 or bar 72 is then lowered into engagement with the cover 28 with the hanger 48 of the slag control shape 32 extending outward through the slot 71 in the lid 70 or the slot 78 in the bar 74.

During this slag control body 32 mounting operation, the pin 52 is held in the second, retracted position against the force of the biasing spring 52. When the hanger 48 has been extended through the aperture 71 in the lid 70 or the aperture 76 in the bar 74, the pin 52 is released to bring the notch 54 in the pin 52 in supporting engagement with the hanger 48 to releasably mount the slag control body 32 in the bore 42 in the cover 28. The cover 28 may then be raised by means of a crane into position covering the open top end 22 of the ladle 10 after a new heat or shot of molten metal has been poured into the ladle 10.

Figure 6:
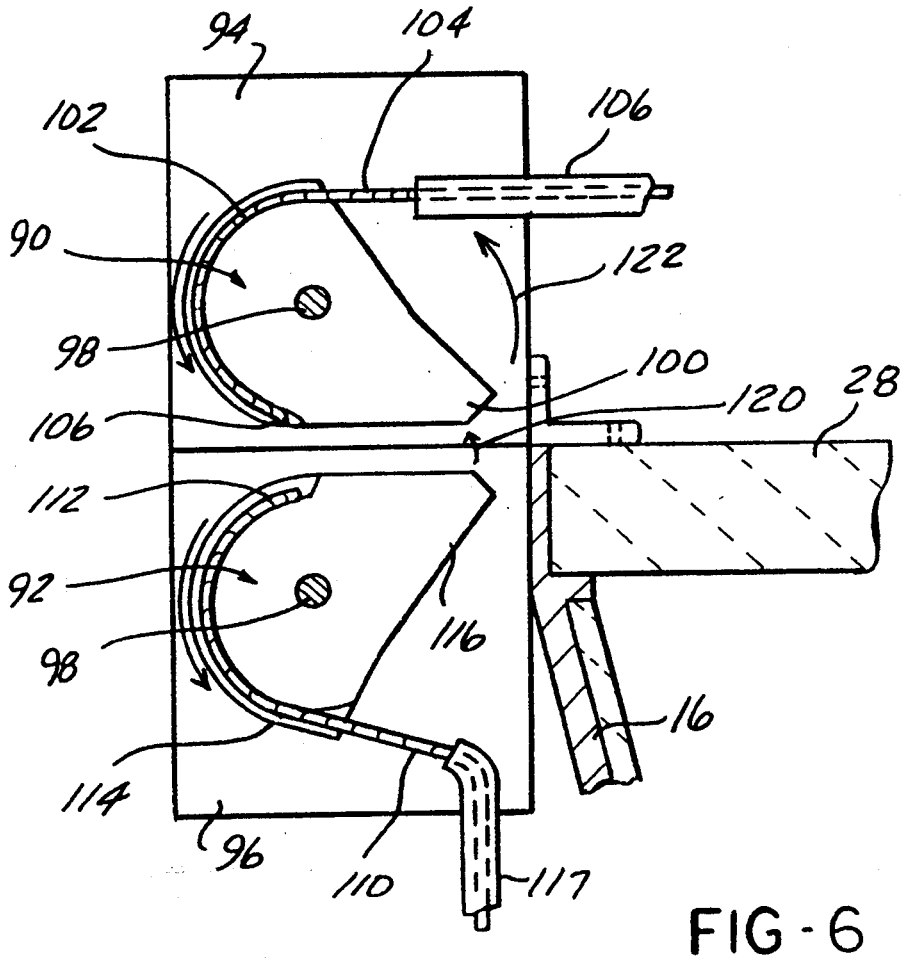
FIG. 6 is a side elevational view of another embodiment of a slag control shape release apparatus of the present invention.
Figure 7:
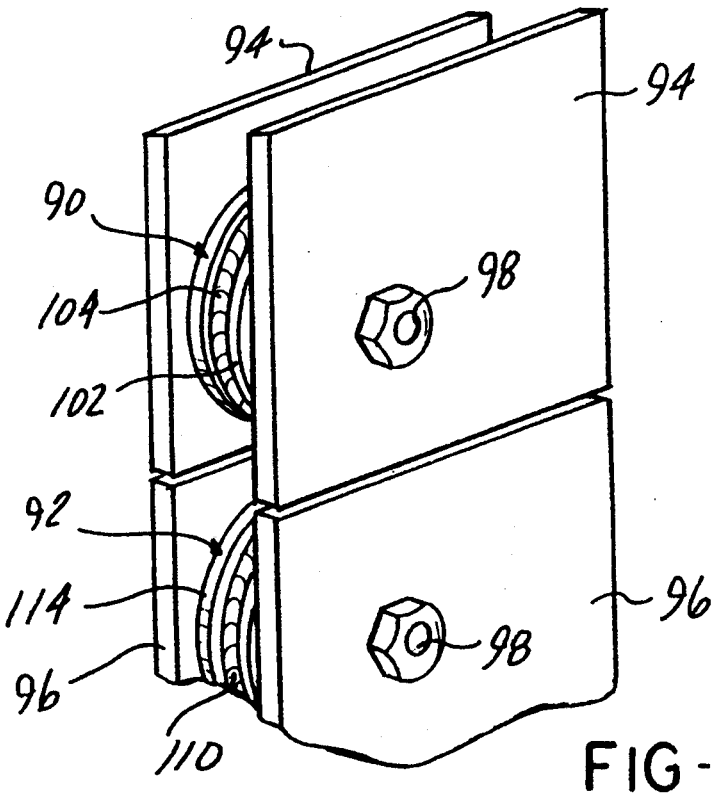
FIG. 7 is a partial, perspective view of the slag control shape release apparatus shown in FIG. 6.

Referring now to FIGS. 6 and 7, there is depicted another embodiment of a means for actuating the pin 52 to release the slag control shape 32 from the cover 28 so as to insert the slag control shape 32 into the ladle 10. In this embodiment, the pin 52, stop bracket 54, biasing spring 56 and stop plate 58 are the same as that described above and shown in FIGS. 1–3 and have not been shown in FIGS. 6 and 7.

The actuating means, in this embodiment, includes first and second eccentric cams 90 and 92, respectively. The first cam 90 is pivotally mounted between a pair of spaced plates, both denoted by reference number 94, which are fixedly attached by suitable means to one edge of the cover 28. A similar pair of plates denoted by reference number 96 are mounted to an upper edge of the side wall 16 of the ladle 10 and pivotally support the second cam 92 therebetween by means of a pivot connection 98 extending through the plates 96 and the second cam 92. A similar pivot pin 98 is used to pivotally mount the first cam 90 between the spaced plates 94.

As shown in FIGS. 6 and 7, the pairs of spaced plates 94 and 96 are disposed in substantial registry when the cover 28 is mounted on the top end 22 of the ladle 10.

The first cam 90 has an elongated leg portion 100 extending from the pivot pin 98. An opposed, generally arcuate-shaped end portion 102 is also formed on the first cam 90. A first cable 104 is fixedly connected at an end 106 to the arcuate section 102 of the first cam 90 and moves with rotation of the first cam 90 as described hereafter. The first cable 104 passes through a cable sleeve 106 mounted to and extending outward from the plates 94 through the stop bracket 54, described above, to a connection with the pin 52.

Similarly, a second cable 110 is fixedly connected at one end 112 to an arcuate end portion 114 formed on the second cam 92. The opposite end of the second cam 92 is formed as an elongated leg 116 as shown in FIG. 6. The second cable 110 passes through a cable sleeve 117 mounted to the spaced plates 96 and downward to its remote second end, not shown.

The legs 100 and 116 of the first and second cams 90 and 92, respectively, are disposed in normal spaced, close proximity as shown in FIG. 6. Downward force on the second cable 110, such as a downward force exerted by the ladleman on the second end of the second cable 110 will cause the second cam 92 to pivot about the pivot pin 98 and thereby move the leg 116 in the direction of arrow 120 into engagement with the leg 100 of the first cam thereby causing rotation of the first cam 90 in the direction of arrow 122. This rotation of the first cam 90 in the direction of arrow 122 exerts a force on the first cable 104 pulling the cable 104 to the left in the orientation shown in FIG. 6. This results in a retraction of the pin 52 from the hanger 48 on the slag control body 32 thereby releasing the slag control body 32 from its mounting position in the cover 28 of the ladle 10. A discontinuance of the downward force on the second cable 110 causes the second cam 92 to return to its normal position shown in FIG. 6. The biasing force exerted by the spring 56 on the pin 52 will simultaneously cause the first cam. 90 to return to its normal position shown in FIG. 6.

Referring now to FIGS. 8–14, there is depicted another embodiment of the present invention in which the slag control shape release apparatus includes means for controlling the descent of the slag control shape into the molten metal vessel.

Figure 8:
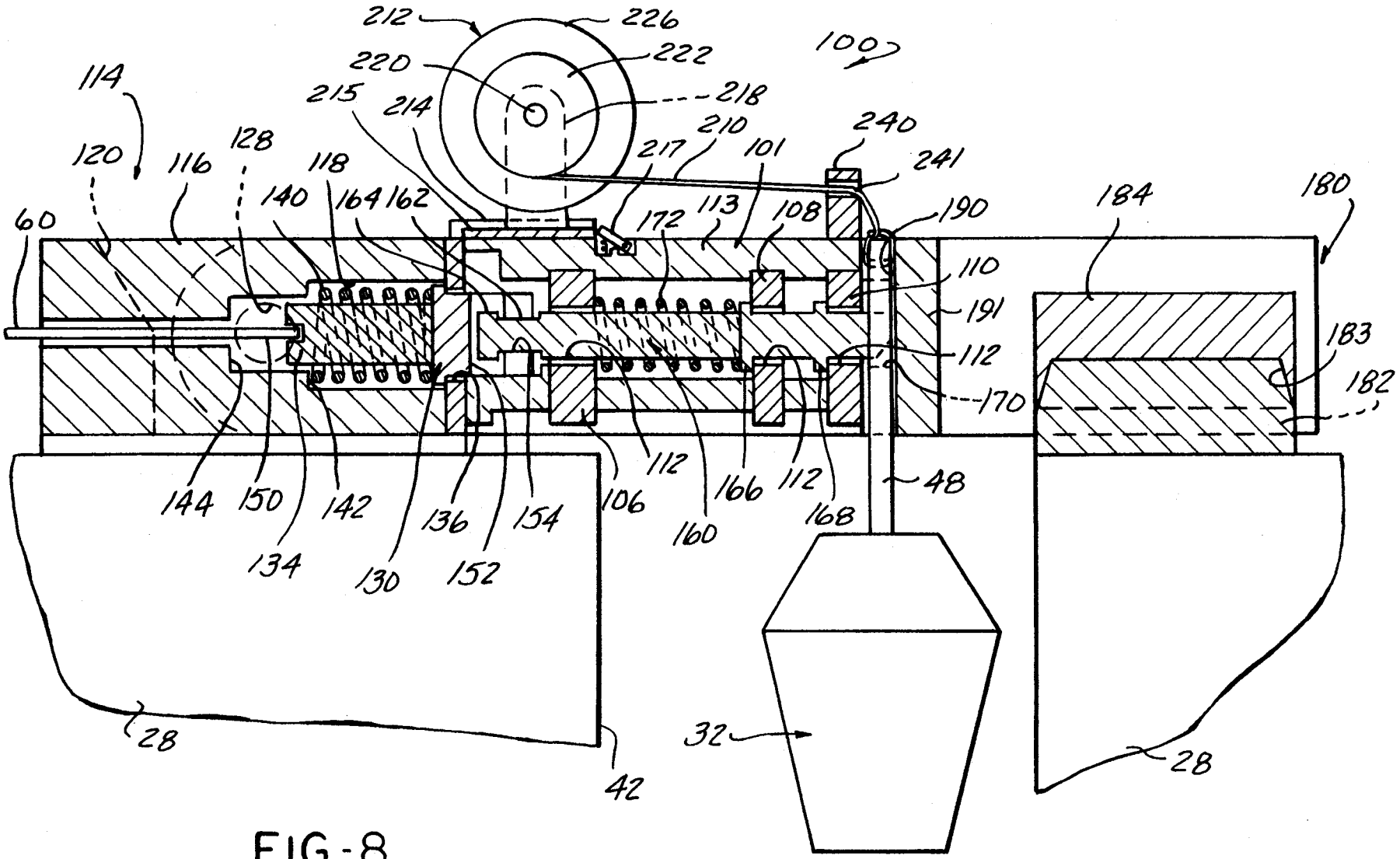
FIG. 8 is a longitudinal cross-section of another embodiment of the apparatus of the present invention.
Figure 9:
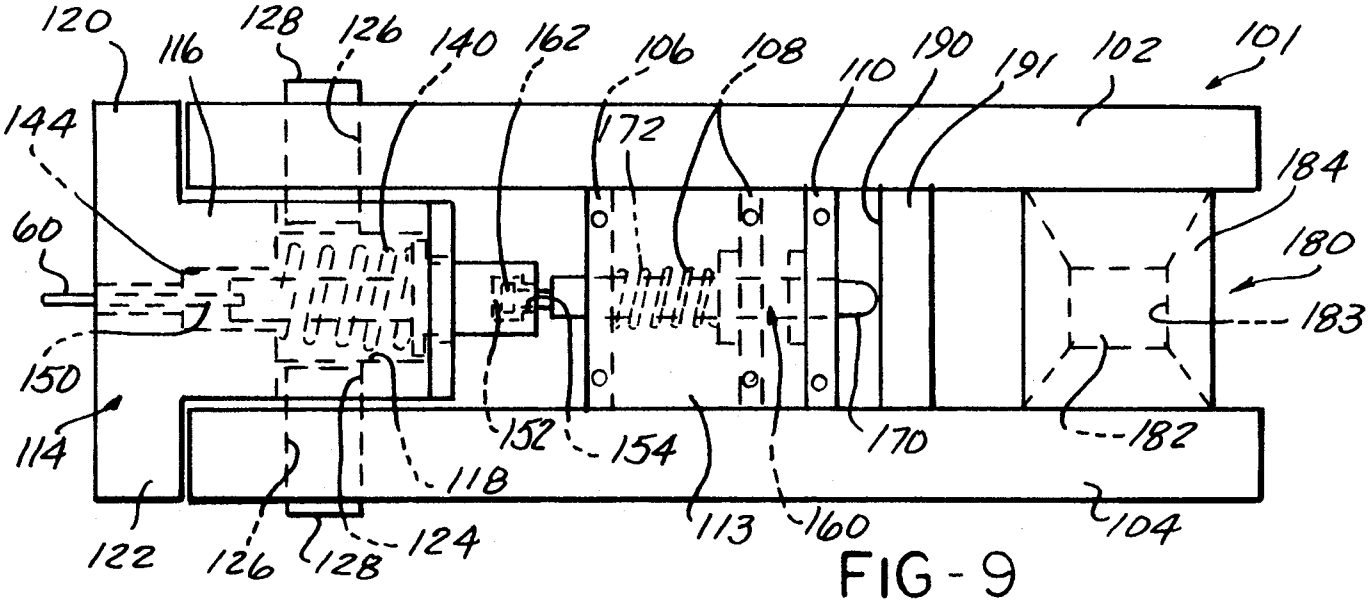
FIG. 9 is a complete plan view of the embodiment shown in FIG. 8.

As shown in FIGS. 8 and 9, a slag control shape 32 having a hanger or rod 48 extending from one end is supported in an aperture 42 in the cover 28 of a molten metal vessel, such as a transfer ladle or tundish, by a releasable mounting means denoted generally by reference number 100. As described above, the aperture or bore 42 is located in the cover 28 directly over the well or tap hole 24 on the vessel 10.

The releasable mounting means 100 includes an arm assembly 101 formed of two spaced arms 102 and 104 which are joined together in a rigid assembly by means of a plurality of interconnecting plates or ribs 106, 108 and 110. Each of the plates 106, 108 and 110 are joined to the arms 102 and 104 by suitable means, such as by welding, or by the use of separate fasteners, not shown. Each of the plates 106, 108 and 110 also includes a central bore 112. The bores 112 are co-axially aligned through all of the plates 106, 108 and 110. A cover plate 113 is fastened to the plates 106, 108 and 110.

Figure 13:
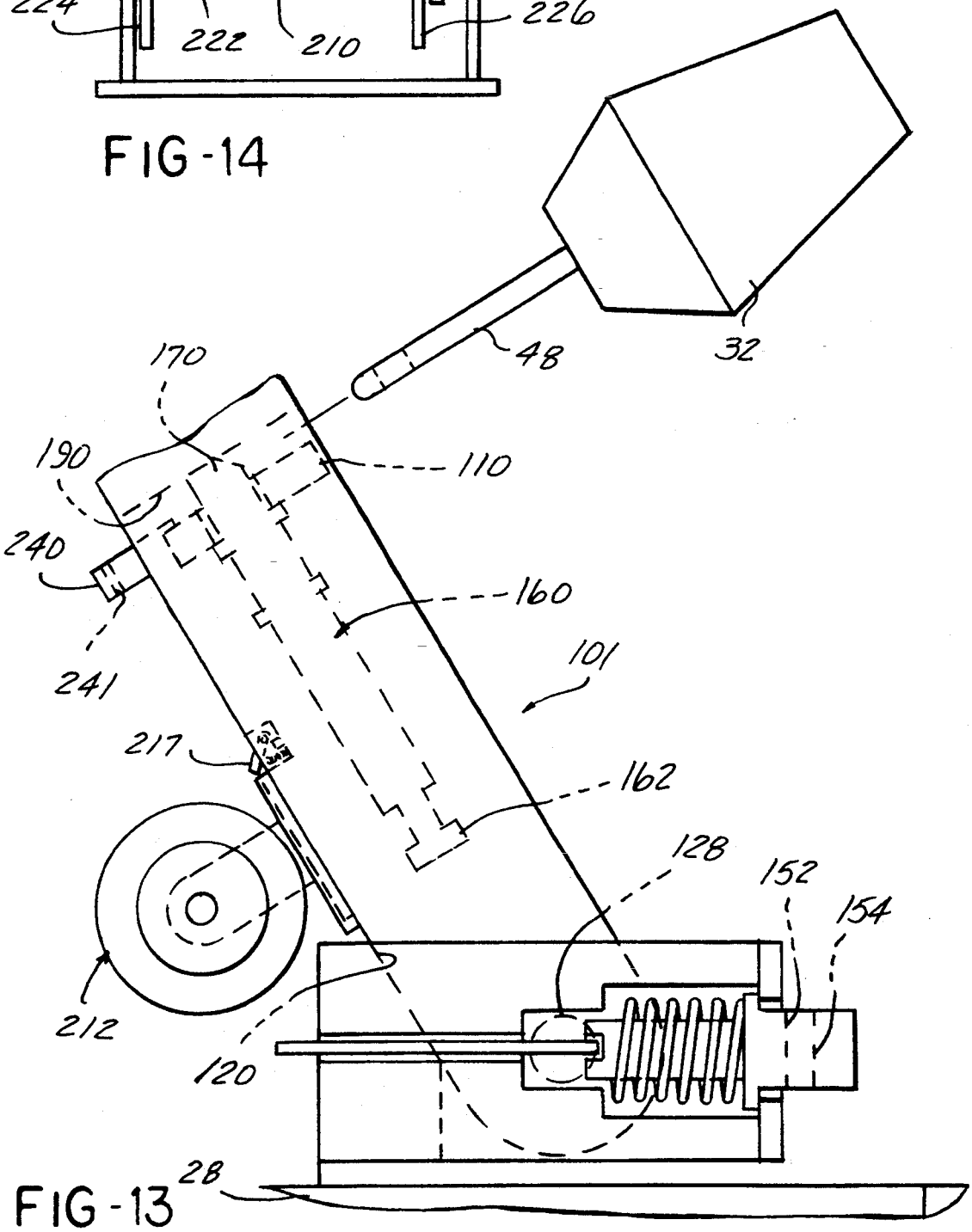
FIG. 13 is a side elevational view showing a pivoted position of the apparatus depicted in FIG. 8.

The arm assembly 101 is pivotally connected to a yoke 114 for pivotal movement from a first position shown in FIG. 8 in which the arm assembly 101 extends substantially horizontally over the top of the cover 28 to a pivoted, angular position shown in FIG. 13. The yoke 114 is formed with a central portion 116 having an internal bore 118 extending inward from one end. The other end of the yoke 114 terminates in a pair of outwardly extending flanges 120 and 122. The yoke 114 is fixedly mounted on the top of the cover 28, adjacent the bore 42 in the cover 28, by suitable means, such as by fasteners, welding, etc., not shown. A transverse bore 124 is formed in the central portion 116 of the yoke 114 and is co-axially aligned with bores 126 formed in one end of each of the arms 102 and 104 of the arm assembly 101. Pivot pins 128 are inserted through the bores 126 in the arms 102 and 104 and into the transverse bore 124 in the yoke 114 to pivotally connect the arm assembly 101 to the yoke 114. Suitable retainers, such as C clips, not shown, may be employed to retain the arms 102 and 104 on the pivot pins 128.

A latch alignment means 180 is mounted on the cover 28 for releasably latching the arm assembly 101 in a horizontal position on the cover 28. The latch alignment means 180 includes a frusto-conical locator 182 which is fixedly mounted to the cover 28. The locator 182 engages an inverted frusto-conical recess 183 formed in a receiver 184, mounted between the arms 102 and 104 of the arm assembly 101, to releasably latch and align the arm assembly 101 in the horizontal position shown in FIGS. 8 and 9. However, the latch alignment means 180 may be disengaged by exerting an upward force on the right most end of the arm assembly 101 to separate the receiver 184 from the locator 182 and to enable the entire arm assembly 101 to be pivoted upward away from the cover 28 as shown in FIG. 13 and described hereafter.

As shown in FIGS. 8 and 9, an actuating means for releasing the slag control shape from the arm assembly 101 includes a plunger 130 which is slidably mounted in the central portion 116 of the yoke 114. The plunger 130 has a first end 132 and an opposed second end 134. The first end 132 slidably extends through an aperture 136 formed in one end wall of the central portion 116 of the yoke 114. An enlarged shoulder 138 is formed on the plunger 130 intermediately between the first and second ends 132 and 134 and engages the edges of the end wall of the central portion 116 of the yoke 114 to limit the outward extension of the first end 132 of the plunger 130 from the yoke 114.

A biasing means 140, such as a coil spring, is disposed about the second end portion 134 of the plunger 130 within the bore 118 in the yoke 114. One end of the biasing means 140 seats against one surface of the shoulder 138 on the plunger 130. The opposite end of the biasing means or spring 140 seats against a shoulder 142 formed between one end of the bore 118 and a smaller diameter bore 144 extending co-axially therefrom within the yoke 114. The biasing means 140 normally biases the plunger 130 in a manner in which the first end 132 of the plunger 130 extends outward from the yoke 114.

The actuating means also includes a flexible cable denoted by reference number 60. The flexible cable 60 is the same as described above and shown in FIGS. 1 and 2. The cable 60 extends through a cable sleeve 64, not shown in FIGS. 8 and 9, which is mounted on the cover 28 in the same manner as shown in FIGS. 1 and 2. One end of the cable 60 is located at an easily accessible position for an operator, such as a ladleman, typically situated near the bottom of the ladle 10 on which the cover 28 is mounted, as described above and shown in FIGS. 1 and 2. The cable 60 may extend down the side of the vessel for a predetermined distance and terminate in a ring, not shown. The ladleman can use a hook to grasp the ring and exert a downward force on the cable 60.

The opposite end 150 of the cable 60 is fixedly attached to the second end 134 of the plunger 130. In this manner, a downward force exerted on the outermost, lower end of the cable 60 causes the plunger 130 to retract into the central portion 116 of the yoke 114 and pulls the first end 132 of the plunger 130 toward the end wall of the central portion 116 of the yoke 114.

As shown in FIGS. 8 and 9, a recess 152 is formed in and extends completely through the first end 132 of the plunger 130. The recess 132 communicates with a narrow slot 154 formed in the outer wall of the first end 132 of the plunger 130.

The releasable mounting means 100 also includes a pin 160 slidably mounted in the bores 112 in the plates 106, 108 and 110 in the arm assembly 101. The pin 160 has a first end 162 with an enlarged end portion 164. The first end portion 164 of the pin 160 is adapted to releasingly engage the recess 152 and the slot 154 in the first end 132 of the plunger 130 so as to join the pin 160 to the plunger 130 such that retraction of the plunger 130, as described above, causes a simultaneous movement of the pin 160 to the left in the orientation shown in FIGS. 8 and 9. At the same time, the first end 162 of the pin 160 is pivotally releasable from the recess 152 in the plunger 130 as described hereafter.

First and second enlarged shoulders 166 and 168 are spaced along the length of the pin 160 and are preferably located in a spaced manner from a second end 170 of the pin 160. The shoulder 166 on the pin 160, which is formed as an enlarged annular flange on the pin 160 intermediate the first and second ends 162 and 170 of the pin 160, is adapted to seat against the plate 108 when the pin 160 is in its normal, extended position, as shown in FIGS. 8 and 9. A biasing means, such as a coil spring 172, is disposed about the central portion of the pin 160 and seats at opposite ends against the plates 106 and 108. The biasing means or spring 172 functions to normally bias the pin 160 to the right in the orientation shown in FIGS. 8 and 9 by exerting force on the shoulder 166 of the pin 160.

The shoulder 168, which is also formed as an enlarged, annular flange on the pin 160, seats against the plate 110 in the arm assembly 101 when the pin 160 is in its normal, extended position, as shown in FIGS. 8 and 9. The shoulders 166 and 168 thus cooperate with the plates 108 and 110 to limit the sliding movement of the pin 160 to the right in the orientation shown in FIGS. 8 and 9. Upon retraction of the pin 160 to the left, as described hereafter, the shoulder 168 will engage the plate 108 to limit the amount of retraction of the pin 160. When the shoulder 168 engages the plate 108, the second end 170 of the pin 160 will be substantially located within the bore 112 in the plate 110 and completely disengaged from the rod 48 on the slag control shape 32.

A through bore 190 is formed in the arm assembly 101 by an end plate 191 mounted on the ends of the arms 102 and 104 and spaced from the plate 110. The bore 190 forms a passageway for receiving the hanger or rod 48 attached to and extending outward from a top end of the slag control shape 32. The bore 190 communicates with the bore 112 in the plate 110 through which the second end 170 of the pin 160 extends into the bore 190. The bore 190 in the arm assembly 101 and the bore 42 in the cover 28 are aligned and positioned substantially coaxially above the discharge outlet or well 24 in the molten metal vessel 10.

Figure 10:
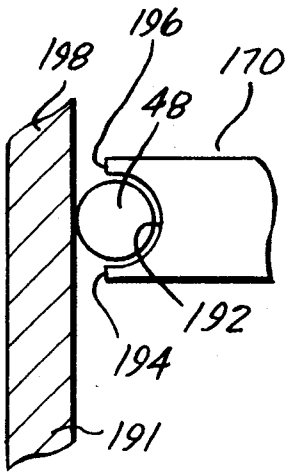
FIG. 10 is an enlarged, plan view of one embodiment of a means for retaining a slag control shape in the apparatus shown in FIGS. 8 and 9.

As shown in FIG. 10, in one embodiment, the second end 170 of the pin 160 is formed with a yoke shape having an arcuate central portion 192 and a pair of end arms 194 and 196 which define an arcuate, open-ended recess therebetween. The radius of the recess is selected to be equal to one-half or slightly less than the diameter of the hanger 48 attached to the slag control shape 32. In this manner, the second end 170 of the pin 160, under the biasing force supplied by the springs 140 and 172, will forcibly engage and hold the hanger 48 on the slag control shape 32 within the bore 190 against the end wall 191 on the arm assembly 101. This retains the slag control shape 32 in the arm assembly 101 of the releasable mounting means 100 as shown in FIG. 8 until its release into the molten metal vessel. The central portion 192 may be provided with a serrated surface in order to more securely engage the hanger 48. Also, the end of the hanger or rod 48 can be slightly flattened to provide added gripping engagement with the pin 170.

Figure 11:
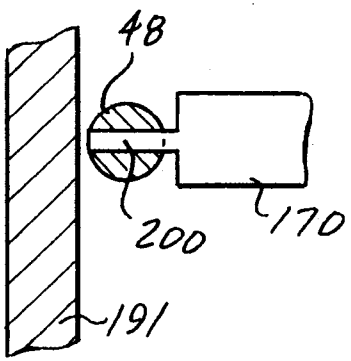
FIG. 11 is an enlarged, plan view of another embodiment of a means for releasably mounting a slag control shape in the apparatus shown in FIGS. 8 and 9.

Another embodiment of the second end 170 of the pin 160 is shown in FIG. 11. In this embodiment, the second end 170 of the pin 160 has a thin pin 200 extending outward from the second end 170 of the pin 160. The pin 200 is adapted to engage a bore or a hoop formed in or attached to the hanger or rod 48 on the slag control shape 32 or directly on the slag control shape 32 to retain the slag control shape 32 in the bore 42 in the cover 28 as shown in FIG. 8. Retraction of the plunger 130 and the pin 160, as described above by a downward force on the cable 60, retracts the thin pin 200 on the second end 170 of the pin 160 from the bore or hoop in the hanger 48 thereby allowing the slag control shape 32 to drop into the molten metal vessel.

Figure 12:
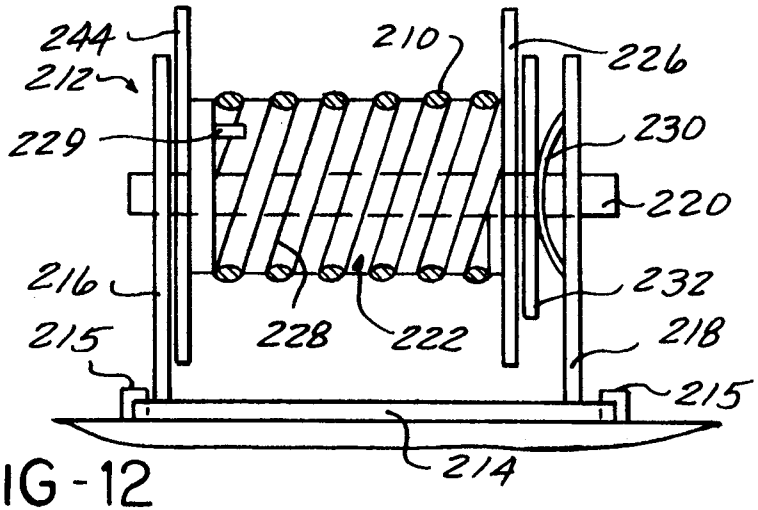
FIG. 12 is a pictorial end view of the cable and reel shown in FIG. 8.

According to a unique feature of the present invention, means is provided for controlling the rate of descent of the slag control shape 32 into the molten metal vessel after release of the slag control shape 32 from the mounting means 100 as described above. As shown in FIGS. 8 and 12, a flexible cable 210 is attached at one end to the hanger 48 on the slag control shape 32 by suitable means, such as by tying for example. The cable 170 may be formed of any suitable material, such as stainless steel wire, carbon steel wire, thermocouple wire, etc.

The other end of the cable 210 is wound in a plurality of turns about a rotatable reel denoted generally by reference number 212. The reel 212, as shown in FIG. 12, includes a base 214 and a pair of upstanding side arms 216 and 218 mounted on and extending upward from the base 214. The base 214 is releasably mounted in a pair of spaced brackets 215 affixed on the cover plate 113 of the arm assembly 101. The brackets 215 form a slot therebetween for slidably receiving the side edges of the base 214 therein. One end of each bracket 215 has an inward extending flange to close the one end and act as a stop for the base 214. A spring-biased latch arm 217 is mounted on the cover plate 113 and is movably biased upward at one end above the top surface of the cover plate 113 to engage one end of the base 214 and to hold the base 214 in a stationary position on the arm assembly 101. A downward force on the outer end of the arm 217 enables the base 214 to be slidably removed from the brackets 215 for replacement, as described hereafter.

A rotatable spindle 220 extends through the arms 216 and 218 and rotatably supports a shaft 222 which is concentrically mounted about the spindle 220. The spindle 220 is held in the arms 216 and 218 by suitable fasteners, such as cotter pins, not shown. The spindle 220 can be removed from the arms 216 and 218 to enable a cable 210 and spindle 220 to be mounted in the reel 212. The shaft 222 includes a pair of enlarged end walls 224 and 226. The shaft 222 may have a smooth shape for receiving the cable 210 thereon in a plurality of wound, overlapping turns. Preferably, however, as shown in FIG. 12, the shaft 222 is formed with a plurality of grooves 228 which are arranged in a spiral configuration along the length of the shaft 222. The grooves 228 are sized to receive one turn of the cable 210 each such that the cable 210 is wound in a plurality of turns, each in a constant diameter across the length of the shaft 222. FIG. 12 is a pictorial representation of the constant diameter grooves, with such grooves being illustrated larger in size and fewer in number than would normally be provided to contain a total cable length of 20 feet or more.

A slot 229, FIG. 12, is formed in the shaft 222 for releasibly receiving one end of the cable 210. The cable 210 is then wound in a plurality of turns about the shaft 222 as described above. In this manner, the cable 220 is releasible from the shaft 222 after it has completely unwound as will occur when the slag control shape 32 is located on the bottom of the vessel 10 and the cover 28 is removed from the vessel 10.

Figure 14:
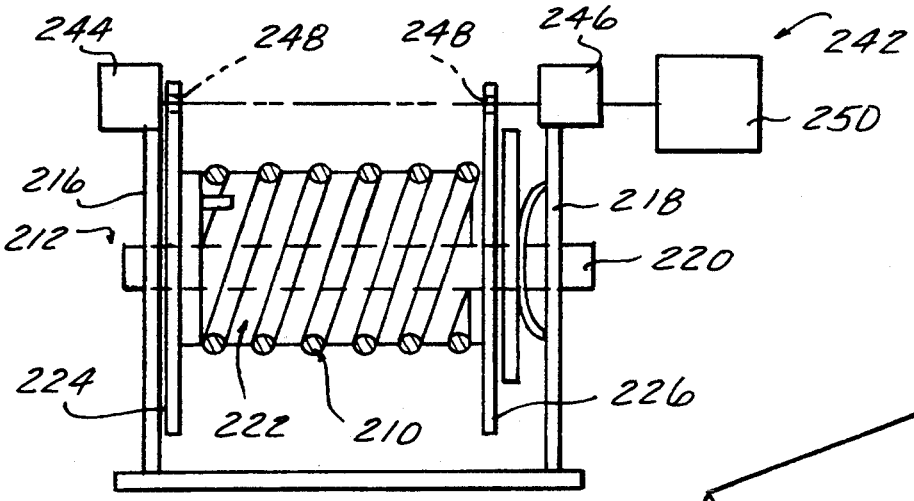
FIG. 14 is an end view of another embodiment of the reel depicting a rotation detector.

By using the constant diameter shaft 222, the length of descent of the slag control shape 32 can be determined by means of a suitable detector or sensor. As shown in FIG. 13, a detector 242 is mounted on the reel 212 and detects the number of rotations of the shaft 222 as the slag control shape 32 descends into the molten metal vessel 10. The number of rotations of the shaft 222 can be used to calculate the length of cable 210 unwound from the shaft 222 so as to provide a measurement of the distance the slag control shape 32 has descended into the molten metal vessel 10 until it reaches the molten metal/slag interface where further descent is halted due to the inherent buoyancy characteristics of the slag control shape 32. When this occurs, further unwinding of the cable 210 from the shaft 222 ceases. However, as molten metal is discharged from the molten metal vessel through the discharge outlet or well 24 shown in FIG. 1, the slag control shape 32 will descend further into the vessel 10 and remain at lower the molten metal/slag interface. This causes further lengths of the cable 210 to unwind from the shaft 222. This distance of unwinding of the cable 210 can be correlated to the amount of molten metal remaining in the vessel 10. Any suitable detector 242 may be employed to detect revolutions of the shaft 222. As shown in FIG. 14, by way of example only, a photoelectric sensor, such as a PZ series sensor sold by Keyence Corporation of America, Fair Lawn, N.J. includes a light beam emitter 244 and a receiver 246 respectively mounted on the arms 216 and 218 of the reel 212. One pair of aligned apertures 248 are formed in the end walls 214 and 226 of the shaft 222. The light beam will pass between the emitter 244 and the receiver 246 once per complete revolution of the shaft 222 when the pair of apertures 248 are aligned between the emitter 244 and the receiver 246. Thus, if the diameter of the shaft 222 is 3.85 inches, for example, each complete revolution of the shaft 222 will equal twelve inches of cable 210 unwound therefrom and twelve inches of descent of the slag control shaft 32 into the vessel 10. The receiver 246 generates an output signal upon detecting each light beam from the emitter 244. The output signal is input to a counter means 250 which, besides counting each signal, is also capable of calculating the length of cable 210 unwound during each revolution of the shaft 222 and/or displaying the length of cable unwinding.

Additional pairs of aligned apertures 248 can be formed in the end walls 224 and 226 at spaced angular positions to increase the resolution of the measurement of the unwinding of the cable 210. Other types of detectors can also be used, such as light reflective detectors in which a tag or patch is mounted on one end wall 224 of the shaft 222 and read or detected by the detector once for each revolution of the shaft 222.

Means are also provided for providing a constant retarding force to the shaft 222 to control the rate of unwinding or payout of the cable 210 from the reel 212. The retarding force means includes a suitable biasing means 230, such as a Belleville washer or washers, which are mounted between the arm 218 and a brake plate 232. The brake plate 232 slidably engages the end wall 226 of the shaft 222. The spring force provided by the washers 230 forces the brake plate 232 into engagement with the end wall 226 and provides a constant frictional force to control the rate of rotation of the shaft 222 and, thereby, the rate of unwinding of the cable 210 and the rate of descent of the slag control shape 32 into the molten metal vessel 10.

A guide member 240 is mounted on the cover plate 113 of the arm assembly 101 at the position adjacent the bore 190 in the arm assembly 101 to guide the cable 210 as it passes from the reel 212 into the bore 190. The guide member 240 is a plate welded or otherwise secured to the cover plate 113 and includes a bore, preferably a slot 241, for receiving the cable 210 therethrough.

In operation, a slag control shape 32 is attached to the slag control shape mounting means 100 after the cover 28 has been removed from the molten metal vessel at the completion of a charge or shot. The cover 28 would normally be placed on the plant floor thereby providing easy access to the slag control shape mounting apparatus 100. The arm assembly 101 is pivoted away from the cover 28, as shown in FIG. 13, by disengaging one end of the arm assembly 101 from the latch 180. During such pivotal movement, the first end 162 of the pin 160 carried in the arm assembly 101 disengages from the recess 152 in the first end 132 of the plunger 130 in the yoke 114.

The arm assembly 101 is raised until it seats against the angled edge of the flanges 120 and 122 on the yoke 114. The hanger 48 of a new slag control shape 32 is then inserted into the recess 190 in the arm assembly 101 and urges the end 170 of the pin to the left until the pin 160 is aligned with the bore in the hanger 48 at which time the pin 160 slides forward to lock the hanger 42 in the arm assembly 101. A length of cable 210 is then unwound from the shaft 222 until the free end of the cable 210 can be attached to one end of the hanger 48 of the slag control shape 32, preferably, by tying to the hanger 42. It should be noted that the free end of the cable 210 will be first passed through the slot 241 in the guide member 240 prior to its attachment to the hanger 48 of the slag control shape 32. The arm assembly is then lowered to a horizontal position, shown in FIG. 8, with the latch means 180 engaging the arm assembly 101 to center the arm assembly 101 in a fixed position on the cover 28. During such downward pivotal movement, the first end 162 of the pin 160 in the arm assembly will reengage the recess 152 in the first end 132 of the plunger 130 to reconnect the pin 160 to the plunger 130.

Figure 15:
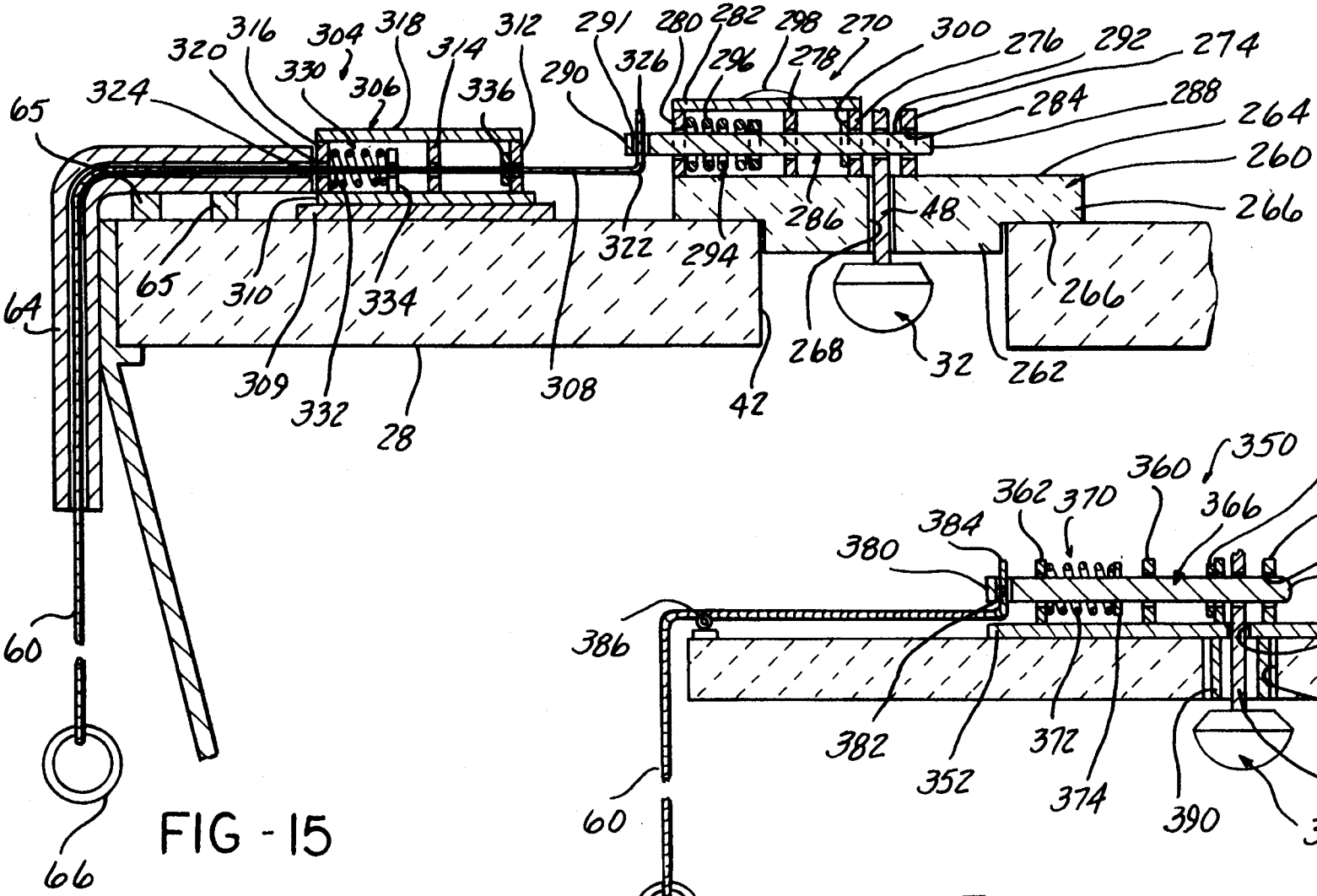
FIG. 15 is a partially cross sectioned, side elevational view of an other embodiment of a slag control shape release apparatus according to the present invention.

In another embodiment shown in FIG. 15, the aperture or bore 42 in the cover is also located directly over the well or tap hole in the molten metal vessel 10 when the cover 28 is mounted on the open top end of the molten metal vessel 10.

In this embodiment, the slag control shape release apparatus includes a lid 260 which is sized to be removably implacable in and to close the bore 42 in the cover 28. The lid 260 may be formed of any suitable material, however, preferably, a refractory material is used to form the lid 260 so as to retain heat within the molten metal vessel. A steel frame may also be employed with the refractory material to form the lid 260. By way of example only, the lid 260 includes a lower, generally circular bottom portion 262 which slidably fits within the bore 42 in the cover 28. An enlarged top end 264 is formed on the lid 260 and forms an annular flange 266 which fits over the top edge of the cover 28 surrounding the bore 42 in the cover 28 to removably support the lid 260 on the cover 28 with the bottom portion 262 of the lid 260 disposed within the-bore 42 in the cover 28.

A bore 268 extends through the lid 260 for receiving the hanger 48 therein.

A mounting means denoted generally by reference number 270 is mounted on the lid 260 for releasibly mounting a slag control shape 32 on the lid 260. The mounting means 270 preferably includes a frame formed of a plurality of spaced plates which are individually fixedly mounted on the top end 264 of the lid 260 by welding or by other means. Optionally, a base plate, not shown, attached to the lid 260 may be with each of the plates affixed to the base plate. Preferably, the frame includes a first plate 274 which is mounted on the top end 264 of the lid 260 adjacent to and on one side of the bore 268 in the lid 260. Immediately adjacent to an opposite side of the bore 268 and aligned with the first plate 274 is a second plate 276. A third and a fourth plate 278 and 280, respectively, are also mounted on the top end 264 of the lid 260 and are aligned with and spaced from each other and from the second plate 276. A top plate 282 is fixedly mounted to the second, third and fourth plates 276, 278 and 280 by welding or by means of suitable fasteners to rigidly hold the second, third and fourth plates 276, 278 and 280 in place.

Each of the plates 274, 276, 278 and 280 has an internal aligned bore denoted by reference number 284. An elongated, tubular rod or pin 286 is slidably disposed through the aligned bores 284. The pin 286 has a first end 288 and an opposed second end 290. The first end 288 of the pin 286 is positioned to slidably extend through the bore 284 in the first plate 274 when the pin 286 is biased to a first, normal position shown in FIG. 15. In this first position, the pin 286 releasibly supports the hanger 48 of a slag control shape 32 on a first end portion 292 adjacent to the first end 288. In the first position of the pin 286, the first end portion 292 is disposed between the first plate 274 and the second plate 276 and over the bore 268 in the lid 260.

A biasing means 294 is mounted about the pin 286 and disposed between the third and fourth plates 278 and 280, respectively, for biasing the pin 286 to the first position. The biasing means 294 preferably comprises a coil spring 296 which seats at one end on the fourth plate 280 and, at another end, against a washer or stop 298 fixedly mounted on the pin 286. A limit or stop means 300 is also fixedly mounted on the pin 286 for limiting the axial advance of the pin 286 to the first position. The limit or stop means 300 preferably comprises a washer 300 fixedly mounted on the pin 286 and disposed between the second and third plates 276 and 278, respectively. When the biasing means 294 urges the pin 286 to the first position, the washer 300 will engage the second plate 276 to limit the sliding advance of the pin 286 so as to position the pin 286 in the normal, first position shown in FIG. 15 in which the first end portion 292 releasibly supports the hanger 48 of a slag control shape 32.

An actuating means denoted generally by reference number 304 is mounted on the cover 28 adjacent to the bore 42 in the cover 28. The actuating means 304 includes a frame structure 306 fixedly mounted on the cover 28. The frame structure 306 slidably supports a plunger 308 therein.

By way of example only, the frame structure 306 includes a base plate 309 which is fixedly mounted on the cover 28. A mounting plate 310 is attached to the base plate 309 and is joined to first, second and third vertically extending plates 312, 314 and 316, respectively, by welding or by suitable fasteners. A top plate 318 is mounted to the outer ends of the first, second and third plates 312, 314 and 316 to form a rigid frame structure. Aligned bores 320 are formed in each of the first, second and third plates 312, 314 and 316 and slidably receive the plunger 308 therethrough.

The plunger 308 is formed with a first end 322 and an opposed second end 324. The first end 322 and the second end 290 of the pin 286 on the mounting 270 are provided with a connecting means for releasibly connecting the first end 322 of the plunger 308 to the second end 290 of the pin 286 when the mounting means 270 and the lid 260 are mounted on the cover 28 of the molten metal receptacle. By way of example only, the connecting means comprises an annular ring formed on the second end 290 of the pin 286, a central aperture 291 formed in the ring. A perpendicular leg 326 is formed on the first end 322 of the plunger 308 and is releasibly insertable through the aperture 291 in the ring portion of the second end 290 of the pin 286 to releasibly attach the plunger 308 to the pin 286.

A biasing means 330 is mounted in the frame structure 306 of the actuating means 304. Preferably, the biasing means 330 includes a coil spring 332 which seats between a washer 334 fixedly mounted on the plunger 308 and the third plate 316 for biasing the plunger 308 to a normal, first position shown in FIG. 15 in which the plunger 308 is positioned to releasibly engage the second end 290 of the pin 286. A limit or stop means 336 is also mounted on the plunger 308 and is disposed between the first and second plates 312 and 314, respectively. The limit or stop means 336 is preferably in the form of a washer which engages the first plate 312 to limit the axial advance of the plunger 308 to the first position under the force of the biasing spring 332.

The second end 324 of the plunger 308 is fixedly connected to a flexible cable denoted generally by reference number 60 and described in detail in the previous embodiments of the present invention. The cable 60 extends through a cable sleeve 64 which is supported by means of blocks 65 on the cover 28. One end of the cable 66 terminates in a ring 60 located at an easily accessible position, such as near the bottom of the ladle or molten metal vessel 10 on which the cover 28 is mounted to enable an operator, such as a ladleman, to grasp the ring 66 and exert a downward force on the cable 68. This downward force causes a sliding movement of the plunger 308 and a simultaneous sliding movement of the pin 286 to the left in the orientation shown in FIG. 15 to move the pin 286 to the second position clear of the bore 268 in the lid 260. During the sliding movement toward the second position, the first end 288 of the pin 286 slides from the first plate 274 on the lid 260 and from the hanger 48 on the slag control shape 32 to release the slag control shape 32 from the lid 260 and to enable the slag control shape 32 to drop into the molten metal vessel. Release of the cable 60 causes the biasing spring 332 to urge the plunger 308 back toward the first position. At the same time, the biasing spring 296 also urges the pin 286 back to the first position shown in FIG. 15.

In operation, when it is necessary to mount a new slag control shape 32 on the pin 286 is released from plunger 308, lid 260 and the lid 260 is removed from the cover 28 and brought to an easily accessible position, such as on the plant floor adjacent to the molten metal vessel or ladle. The pin 286 is then manually urged to the second position to bring the first end 288 of the pin 286 in close proximity with the second plate 276. The hanger 48 of a slag control shape 32 is inserted through the bore 268 in the lid 260 and the pin 286 released such that the first end 288 of the pin 286 slides through the hanger 48 and the aperture 284 in the first plate 274 to support the hanger 48 of the slag control shape 32 on the first end portion 292 of the pin 286.

The lid 260 is then remounted in the bore 42 in the cover 28 with the annular ring 290 on the second end of the pin 286 inserted over the perpendicular leg 326 on the first end 322 of the plunger 308 to connect the mounting means 270 to the actuating means 304. The apparatus is then in an operative condition for release of the slag control shape 32 at the proper time.

It should also be noted that a flexible cable 210 and reel 212 may be mounted on the mounting means 270, with the cable 210 attached to the hanger 48 of the slag control shape 32, in the same manner as described above and shown in FIGS. 8 and 9, to control the descent of the slag control shape into the molten metal vessel after the hanger 48 of the slag control shape 32 has been released from the pin 286 by the actuating means 304.

Figure 16:
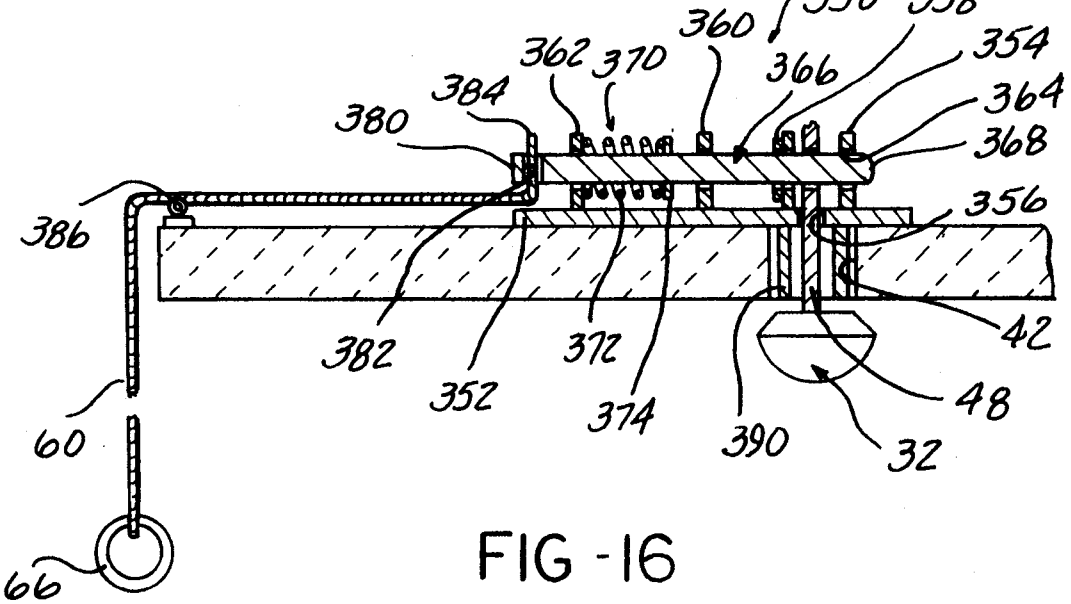
FIG. 16 is a partially cross sectioned, side elevational view yet another embodiment of a slag control shape release apparatus according to the present invention.

Another embodiment of a slag control shape release apparatus according to the present invention is shown in FIG. 16. In this embodiment, the release apparatus is denoted generally by reference number 350 and is in the form of a self contained unit which is removably implacable in the bore 42 of the cover 28 on the top end of a molten metal receptacle.

The release apparatus 350 includes an elongated base 352 formed of a metallic material, such as steel. A plurality of spaced, generally vertically extending plates are fixedly mounted on the base 352 and extend outward from one surface of the base 352. The plurality of plates include a first plate 354 mounted on the base 352 immediately adjacent one side of an aperture 356 formed in the base 352. Second, third and fourth plates 358, 360 and 362, respectively, are also mounted on the base 352 and are spaced from each other, with the second plate 358 spaced from the first plate 354 and positioned adjacent to an opposite side of the aperture 356 in the base 352. A top, not shown but similar to top 318 in FIG. 15 may be fixedly joined to the second, third and fourth plates 358, 360 and 362, respectively, to rigidly join the plates together. Aligned bores, each denoted by reference number 364, are formed in each of the first, second, third and fourth plates 354, 358, 360 and 362 and slidably receive an elongated, tubular pin 366 therethrough.

The pin 366 has a first end 368 which slidably extends through the aperture 364 in the first plate 354 when the pin 366 is in a first, normal position shown in FIG. 16 in which a first end portion 370 of the pin 368 extends over the aperture 356 in the base 352 for releasibly supporting the hanger 48 of the slag control shape 32 thereon. A biasing means 370 is mounted between the third and fourth plates 360 and 362 and is coupled to the pin 366 for normally urging the pin 366 to the first position shown in FIG. 16. Preferably, the biasing means 370 comprises a coil spring 372 which surrounds the pin 366 and seats between the fourth plate 362 and a washer 374 fixedly mounted on the pin 366. A limit or stop means preferably in the form of a washer 376 fixedly mounted on the pin 366 is disposed between the second and third plates 358 and 360 and engages the second plate 358 to limit the axial advance of the pin 366 to the first position shown in FIG. 16. It should be noted that the washer 374 can also act as the limit or stop in place of the washer 376.

A second end 380 of the pin 366 is provided with a releasible connecting means which cooperates with a mating part of the releasible connecting means mounted on one end of a flexible cable 60. Similar to the embodiment shown in FIG. 15, the connecting means preferably comprises an annular ring 382 formed on the second end 380 of the pin 366 which releasibly engages a perpendicular leg 384 attached to one end of the flexible cable 60. The flexible cable 60 may be mounted in a cable sleeve, similar to cable sleeve 64 shown in FIG. 16 or it may be freely disposed over the cover 28 and through a pulley 386 mounted on an outer edge of the cover 28. The free end of the cable 60 extends to a remote, easily accessible position with respect to the molten metal vessel on which the cover 28 is mounted to provide for sliding actuation of the pin 366 to a second position, in the same manner as described above in the embodiment shown in FIG. 15. Release of the opposite end of the cable 60 enables the biasing means 370 to urge the pin 366 back to the first, normal position shown in FIG. 16.

A guide means 390 is mounted on the base 352 and extends outward from a surface of the base 352 opposite from the surface on which the plates 354, 358, 360 and 362 are mounted. The guide means 390 may be in the form of a pair of spaced plates which are spaced apart a distance substantially equal to the diameter of the bore 42 in the cover 28. Preferably, however, the guide means 390 comprises a hollow, tubular member made of steel, stainless steel, ceramic and the like and having a diameter slightly less than the diameter of the bore 42 in the cover 28.

In use, the pin 366 is manually retracted to the second position. The hanger 48 of a slag control shape 32 is then inserted from the lower side of the cover 28 through the guide means 390 and the aperture 356 in the base 352 and raised into position by means of a rod or cable with a hook at one end, for example, until the opening in the hanger 48 is aligned with the pin 366. The pin 366 is then released to enable the biasing means 370 to slide the pin 366 to the first position with the first end 368 of the pin 366 sliding through the hanger 48 and the bore 364 in the first plate 354 and the first end portion 370 moved to a position supporting the hanger 48.

In summary, there has been disclosed a unique slag control shape release apparatus for use with molten metal vessels which enables a slag control shape or body to be easily inserted into the molten metal vessel at the appropriate time without requiring the use of cranes or the necessity of having the ladleman or another worker climb a stairway to manually insert the slag control shape into the vessel. The apparatus is conveniently mounted on a cover emplaced on the open top end of the vessel so as to easily position the slag control shape in the cover prior to its insertion into the vessel. The apparatus of the present invention simplifies the insertion of slag control shapes into molten metal vessels, such as ladles or tundishes, and enables the ladleman who normally monitors the metal making process utilizing the ladle or tundish to conveniently insert the slag control shape into the molten metal vessel at the appropriate time without disrupting his other duties.

The unique slag control shape release apparatus of the present invention also includes means for controlling the descent and, particularly, the rate of descent of the slag control shape into a molten metal vessel. This ensures that the slag control shape remains centered over the discharge outlet of the molten metal vessel so as to enable the slag control shape to consistently engage the discharge outlet or well at the proper time to prevent the discharge of slag through the discharge outlet. The controlled rate of descent of the slag control shape provided by the apparatus of the present invention ensures that the slag control shape remains centered over the discharge outlet and does not move away from a centered position above the discharge outlet prior to the formation of a vortex above the discharge outlet when the molten metal/slag interface reaches a low level in the molten metal vessel.

The provision of a cable reel rotation detector and counter uniquely provides an indication of the amount of molten metal remaining in the vessel by determining the length of cable paid out from the reel as the slag control shape, which buoyantly floats at the slag/-molten metal interface, descends into the vessel as molten metal is discharged therefrom.

Finally, several embodiments of the present release apparatus are constructed in a lightweight design so as to be useable with molten metal receptacle covers formed of lightweight refractory or ceramic materials.

What is claimed is:

1. A slag control shape release apparatus for a molten metal receptacle having an open top and a cover closing the open top of the receptacle, with a bore formed in and extending through the cover, the apparatus comprising:

a lid removably implacable in and closing the bore in the cover, a bore formed through the lid and opening to the molten metal receptacle;

means, mounted on the lid, for releasibly mounting a slag control shape through the bore in the lid; actuating means, mounted on the cover and connected to the mounting means, for actuating the mounting means to release the slag control shape from the mounting means into the molten metal receptacle, the actuating means being operable from a location remote from the cover mounted on the molten metal receptacle; and means for releasibly connecting the actuating means to the mounting means when the lid is mounted on the cover.

2. The apparatus of claim 1 wherein the mounting means comprises:

a frame mounted on the lid;

a tubular pin having first and second ends, the pin slidably supported in the frame for movement between a first, normal position wherein a first end portion of the pin is disposed over the bore in the lid for releasibly supporting a hanger of a slag control shape thereon, and a second position in which the first end of the pin is displaced from the bore in the lid; and biasing means, mounted on the frame and cooperating with the pin, for biasing the first end of the pin to the first position extending over the bore in the lid.

3. The apparatus of claim 2 wherein the mounting means further comprises:

means, mounted on the pin and cooperating with the frame, for limiting the axial movement of the pin to the first position.

4. The apparatus of claim 2 wherein the releasible connecting means comprises:

an aperture formed in one of the second end of the pin and one end of the actuating means; and a projection formed on the other of the second end of the pin and the one end of the actuating means, the projection releasibly engagable with the aperture.

5. The apparatus of claim 2 wherein the actuating means comprises:

a frame adapted to be mounted on a cover of a molten metal receptacle;

a plunger slidably mounted in the frame and having first and second ends; and biasing means, mounted in the frame and acting on the plunger, for biasing the first end of the plunger toward the second end of the pin.

6. The apparatus of claim 1 wherein the actuating means further comprises:

a flexible cable having a first end connected to the second end of the plunger;

the flexible cable having a second end located remote from the first end thereof at an easily accessible position for retraction of the plunger and the pin connected thereto from the first position to a second, retracted position in which the pin is released from the slag control shape.

7. A slag control shape release apparatus for a molten metal vessel having an open top and a cover closing the open top of the receptacle, with a bore formed in and extending through the cover, the apparatus comprising:

a base having an aperture extending therethrough;

a pin having first and second ends;

means, mounted on the base, for mounting the pin for axial sliding movement between a first position in which the first end of the pin extends over the aperture in the base and a second position in which the first end of the pin is displaced from the aperture in the base in an opposite direction from the first position;

actuating means, connected to the second end of the pin, for sliding the pin to the second position to release a slag control shape from the pin and to allow the descent of the slag control shape into the molten metal receptacle, the actuating means being operable from a location remote from the cover mounted on the molten metal receptacle; and guide means, fixedly mounted on the base concentric with the aperture in the base and extending therefrom, and removably insertable into the bore in the cover, for mounting the base on the cover.

8. The apparatus of claim 7 wherein the mounting means comprises:

a plurality of spaced plates mounted on the base;

aligned apertures formed in each of the plates for slidably receiving the pin therethrough; and biasing means, coacting with the pin and one of the plurality of plates, for normally biasing the pin to the first position.

9. The apparatus of claim 8 wherein the mounting means further comprises:

means, mounted on the pin and engagable with one of the plates, for limiting the axial movement of the pin to the first position.

10. The apparatus of claim 7 further comprising:

means for releasibly connecting the actuating means to the mounting means when the base is mounted on the cover.

11. A slag control shape release apparatus for a molten metal receptacle having an open top and a cover closing the open top of the receptacle, with a bore formed in and extending through the cover, the apparatus comprising:

means, removably mounted on the cover, for releasibly mounting a slag control shape through the bore in the cover;

actuating means, mounted on the cover, for actuating the mounting means to release the slag control shape from the mounting means into the molten metal receptacle, the actuating means being operable from a location remote from the cover mounted on the molten metal receptacle; and means for releasibly connecting the actuating means to the mounting means to permit removal of the mounting means from the cover for mounting a slag control shape in the mounting means.

* * * * *